US006564683B1

(12) United States Patent
Tsai

(10) Patent No.: US 6,564,683 B1
(45) Date of Patent: May 20, 2003

(54) MULTI-HEIGHT CAN BODY CUTTING APPARATUS ADAPTED TO CUT CAN BODY OF DIFFERENT HEIGHTS

(76) Inventor: Jimmy Tsai, No. 204, Chingpu Rd., Chingshui Town, Taichung County (TW)

( * ) Notice: Subject to any disclaimer, the term of this patent is extended or adjusted under 35 U.S.C. 154(b) by 21 days.

(21) Appl. No.: 09/985,716

(22) Filed: Nov. 6, 2001

(51) Int. Cl.[7] ..... B23B 3/22; B23B 9/60
(52) U.S. Cl. ..... 82/122; 82/129
(58) Field of Search ..... 82/54, 83, 89, 82/122, 129, 91, 92; 83/733, 349, 410.9, 411.1; 413/69

(56) References Cited

U.S. PATENT DOCUMENTS 3,040,493 A * 6/1962 Wheaton ..... 53/167
4,257,293 A * 3/1981 Stahl ..... 83/193
4,404,836 A * 9/1983 Saunders ..... 72/332
4,642,971 A * 2/1987 Gilkey ..... 53/435
4,833,865 A * 5/1989 Chong ..... 53/517
5,564,321 A * 10/1996 Rath ..... 83/98
5,694,822 A * 12/1997 Maidment ..... 83/114

* cited by examiner

*Primary Examiner*—A. L. Wellington
*Assistant Examiner*—Brian Walsh
(74) *Attorney, Agent, or Firm*—Rosenberg, Klein & Lee

(57) ABSTRACT

A multi-height cutting apparatus includes a fixed cutting tool means disposed around a central axis, the fixed cutting tool means having at least one cutting edge, and a plurality of rotary cutting tool means spaced between the column and the fixed cutting tool means and respectively rotated to cut can bodies being delivered one after another through a circular path between the at least one cutting edge of the fixed cutting tool means and the rotary cutting tool means, the at least one cutting edge of the fixed cutting tool means each having a stepped cutting structure, the rotary cutting tool means each having a cutting edge in a stepped structure thereof corresponding to the at least one cutting edge of the fixed cutting tool means for cutting each delivered can body at different heights.

12 Claims, 11 Drawing Sheets

MULTI-HEIGHT CAN BODY CUTTING APPARATUS ADAPTED TO CUT CAN BODY OF DIFFERENT HEIGHTS

BACKGROUND OF THE INVENTION

The present invention relates to a cutting apparatus and, more particularly, to a multi-height can body cutting apparatus that is practical to cut a can body into different heights.

A variety of can body cutting apparatus are commercially available. DE3619322 shows an example. However, conventional can body cutting apparatus are designed for cutting a can body into a particular height only.

SUMMARY OF THE INVENTION

The present invention has been accomplished to provide a multi-height can body cutting apparatus that is practical to cut a can body into different heights. According to one aspect of the present invention, the multi-height cutting apparatus comprises a fixed cutting tool means disposed around a central axis, the fixed cutting tool means having at least one cutting edge, and a plurality of rotary cutting tool means spaced between the column and the fixed cutting tool means and respectively rotated to cut can bodies being delivered one after another through a circular path between the at least one cutting edge of the fixed cutting tool means and the rotary cutting tool means, the at least one cutting edge of the fixed cutting tool means each having a stepped cutting structure, the rotary cutting tool means each having a cutting edge in a stepped structure thereof corresponding to the at least one cutting edge of the fixed cutting tool means for cutting each delivered can body at different heights. According to another aspect of the present invention, the multi-height cutting apparatus further comprises a shaft axially mounted in the column, and a rotary table mounted on the top side of the shaft and adapted for rotating can bodies on the rotary cutting tool means against the at least one cutting edge of the fixed cutting tool means. According to still another aspect of the present invention, one half of the outer diameter of said rotary table is greater than the shortest distance between the at least one cutting edge of the fixed cutting tool means and the longitudinal central axis minus the diameter of the can bodies. According to still another aspect of the present invention one half of the outer diameter of the rotary table is about equal to ½~⅚ of the shortest distance between the at least one cutting edge of the fixed cutting tool means and the longitudinal central axis minus the diameter of the can bodies, or preferably equal to ⅔ of shortest distance between the at least one cutting edge of the fixed cutting tool means and the longitudinal central axis minus the diameter of the can bodies. According to still another aspect of the present invention, the rotary table has a grained peripheral face. According to still another aspect of the present invention, the fixed external cutting tool means comprises a top cutting segment, an intermediate cutting segment, and a bottom cutting segment; the rotary cutting tool means comprises a shank, a first end block and a second end block respectively provided at top and bottom ends of the shank, a barrel supported on spring means around the shank between the end blocks. According to still another aspect of the present invention, the rotary cutting tool means has barrel-like external flexible members disposed at top and bottom sides of the stepped cutting edge thereof. According to still another aspect of the present invention, the cutting edge the cutting blade of the fixed cutting tool means is corrugated and extended vertically along the length of the cutting blade. According to still another aspect of the present invention, the rotary table has a grained cylindrical peripheral face. According to still another aspect of the present invention, the rotary cutting tool means is matched with a pair of rolling barrels adapted for guiding each can body into position for cutting. According to still another aspect of the present invention, the rotary table is connected in parallel to the rotary carrier and turned about the longitudinal central axis, having a plurality of rollers arranged in pair in parallel to the longitudinal central axis at the periphery thereof and adapted for squeezing the can body on each of the rotary cutting tool means against the fixed cutting tool means.

DETAILED DESCRIPTION OF THE PREFERRED EMBODIMENT

Figure 1:
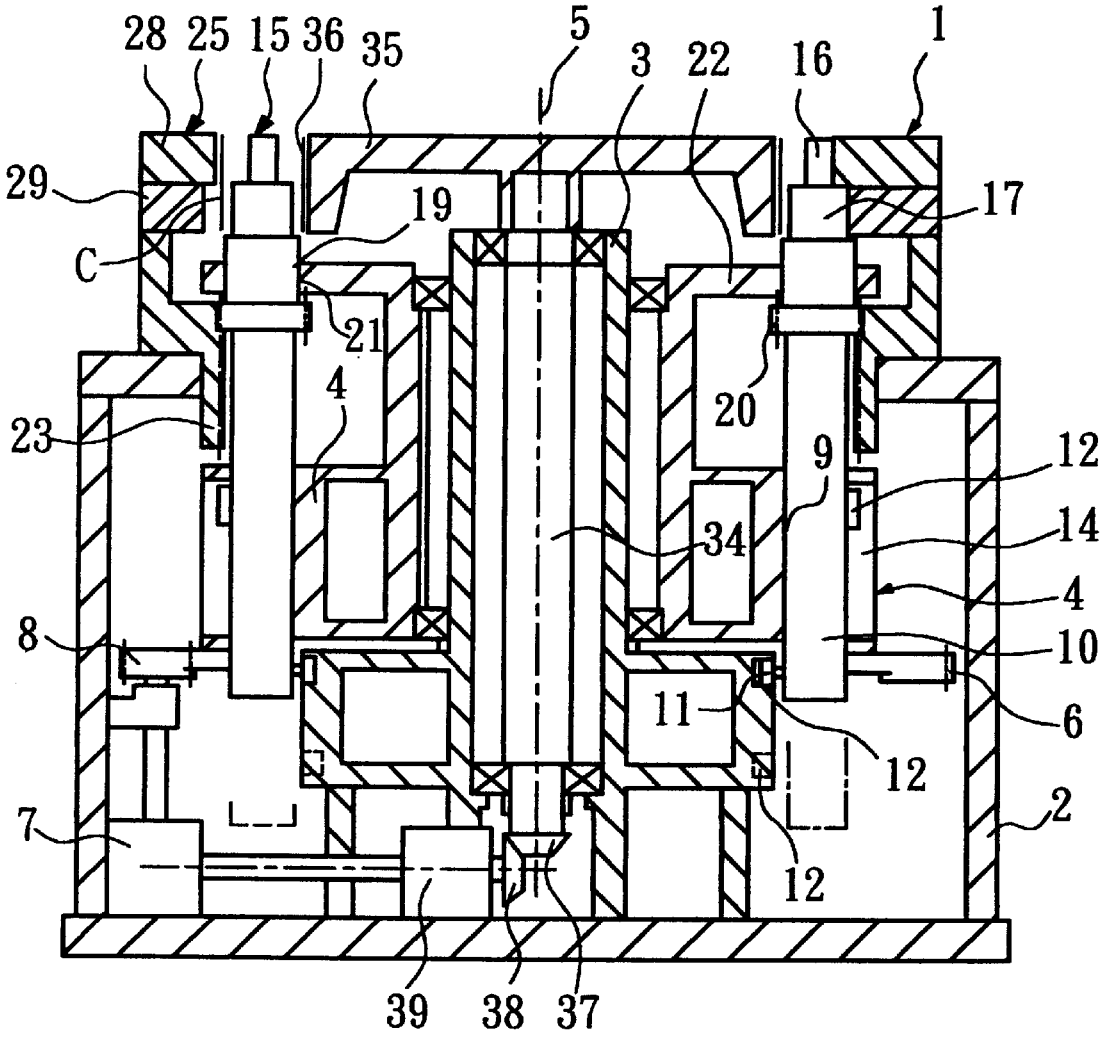
FIG. 1 is a sectional view taken along line I—I of the cutting apparatus constructed shown in FIG. 2.
Figure 2:
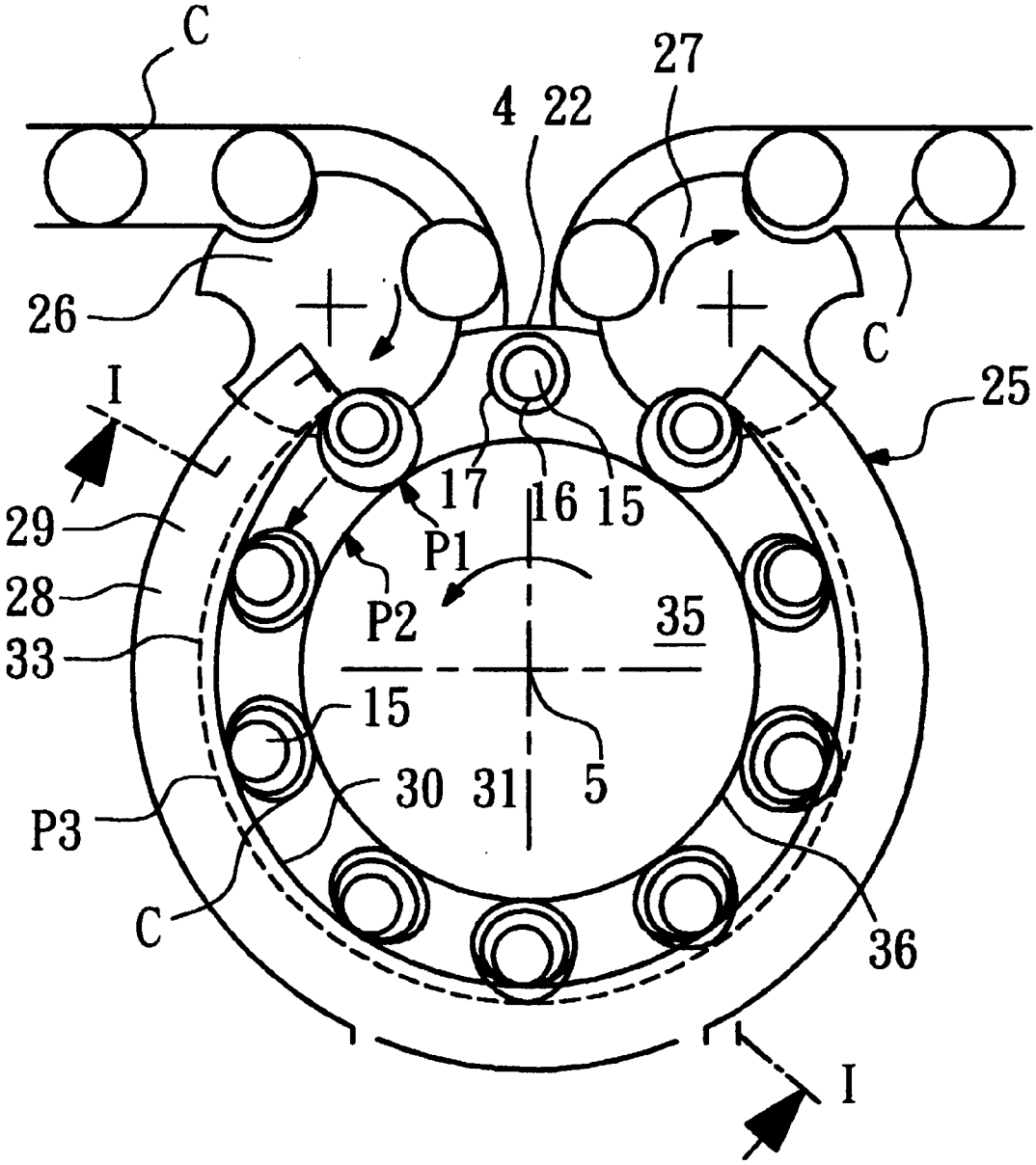
FIG. 2 is a top view of a cutting apparatus constructed according to the present invention.
Figure 4:
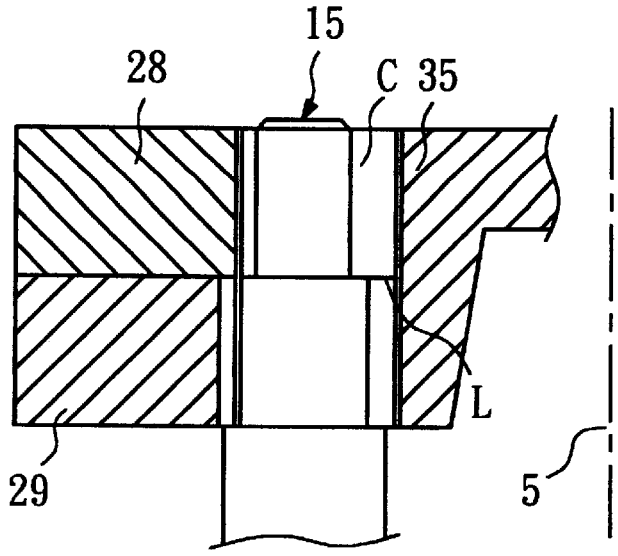
FIG. 4 illustrates the position of the rotary cutting tool relative to the external cutting tool upon the entry of the workpiece (position P2 in FIG. 2).

Referring to FIGS. 1 and 2, a cutting apparatus 1 is shown comprising a machine base 2, a column 3 vertically disposed at the center inside the machine base 2, a rotary carrier 4 mounted around the column 3 and turned about the longitudinal central axis 5 of the column 3, an annular gear 6 fixedly fastened to the bottom sidewall of the rotary carrier 4, a pinion 8 meshed with the annular gear 6, and a driving unit 7 adapted to rotate the pinion 8. The rotary carrier 4 comprises a plurality of vertical guide holes 9 equiangularly spaced from one another and disposed in parallel to the longitudinal central axis 5 of the column 3. Axles 10 are respectively slidably mounted in the vertical guide holes 9, each having a peripheral wedge block 13 inserted into a vertical guide groove 14 in the corresponding vertical guide hole 9. Rollers 11 are respectively coupled to the axles 10 below the rotary carrier 4 and coupled to a peripheral groove 12 in the bottom flange of the column 3. Four rotary cutting tools 15 are provided above the axles 10. The rotary cutting tools 15 are shaped like a stepped cylinder, each comprising a thinner top tool body 16, a thicker bottom tool body 17, and a cutting edge 18 disposed between the thinner top tool body 16 and the thicker bottom tool body 17. Cylindrical members 19 are respectively fixedly connected to the thicker bottom tool body 17 of each of the rotary cutting tools 15. Transmission gears 20 are respectively fixedly mounted on the cylindrical members 19. When the transmission gears 20 meshed with an internal gear 23 in the machine base 2, the rotary cutting tools 15 are rotated on their own axis during rotary motion of the rotary carrier 4, and at the same time the cylindrical members 19 are respectively engaged into respective holes 21 in to the flange 22 above the rotary carrier 4. The rotary cutting tools 15 control the elevation of the axles 10 in the vertical guide holes 9. The internal gear 23 has a height corresponding to the moving range of the axles 10 in the vertical guide holes 9.

A smoothly arched external cutting tool 25 is fixedly mounted on the machine base 2 and extended through about 288° around the rotary cutting tools 15. An input gear 26 and an output gear 27 are respectively disposed at two distal ends of the external cutting tool 25. The external cutting tool 25 has an upper cutting segment 28, a lower cutting segment 29, and a cutting edge 30 in the bottom side of the upper cutting segment 28. The cutting edge 30 is comprised of an inner face 31 and a bottom coating layer 32. The lower cutting segment 29 has an inner face 33.

A shaft 34 is axially mounted in the column 3. A rotary table 35 is mounted on the top side of the shaft 34, having a grained peripheral face 36. A first bevel gear 37 is fixedly mounted on the bottom side of the shaft 34. A second bevel gear 38 is meshed with the first bevel gear 37 and coupled to the driving unit 7 through a transmission mechanism 39. The transmission mechanism 39 is an adjustable transmission gearbox.

There is a pitch in the entrance (the position P1 shown in FIG. 2) between the inner faces 31 and 33 of the external cutting tool 25 and the path for the rotary cutting tools 15 around the longitudinal central axis 5 of the column 3 for receiving cylindrical can body C.

Figure 3:
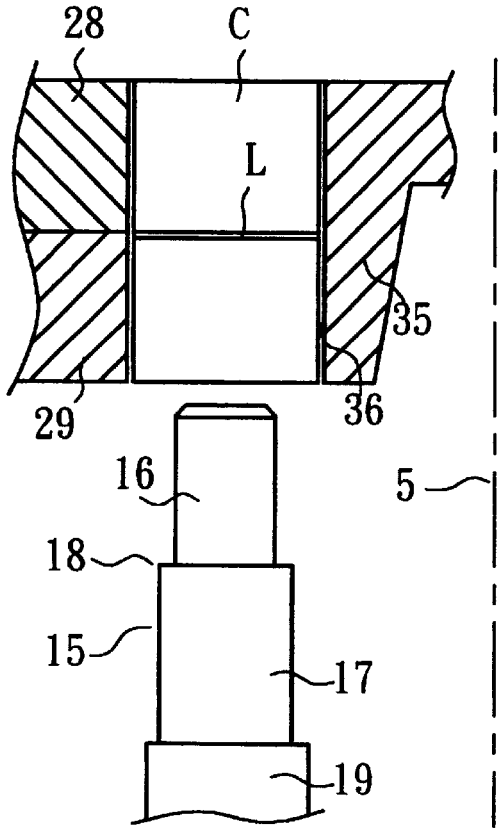
FIG. 3 illustrates the position of the rotary cutting tool relative to the external cutting tool before the entry of the workpiece (position P1 in FIG. 2).
Figure 6:
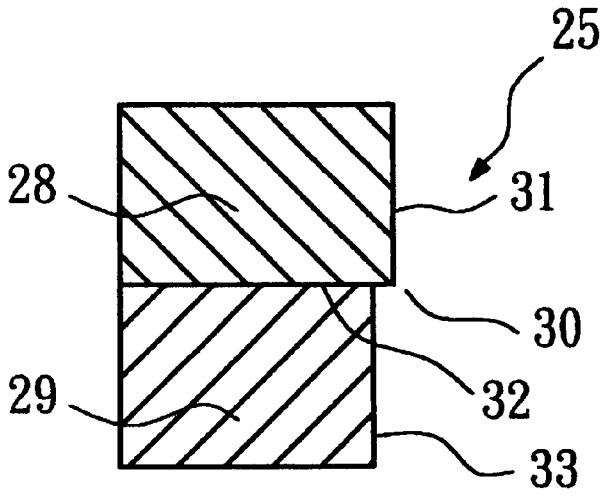
FIG. 6 is a sectional view of a part of the smoothly arched external cutting tool according to the present invention.
Figure 5:
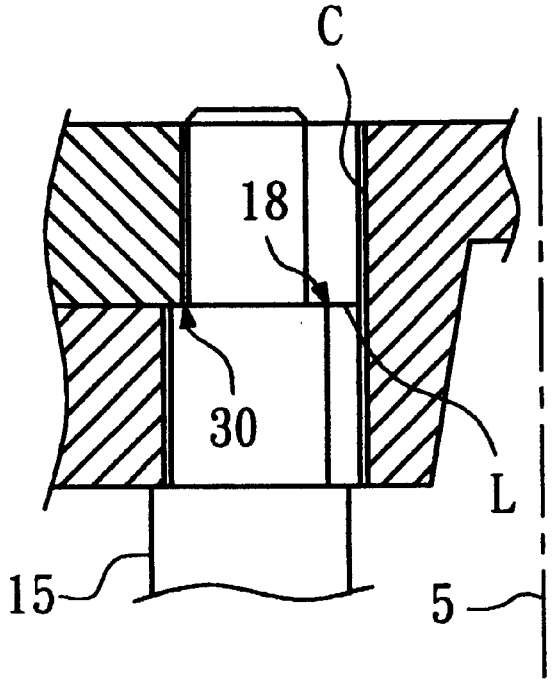
FIG. 5 illustrates the position of the rotary cutting tool relative to the external cutting tool during cutting (position P3 in FIG. 2).

During rotary motion of the rotary carrier 4 relative to the peripheral groove 12 in the bottom flange of the column 3, the rotary cutting tool 15 between the input gear 26 and the output gear 27 is pulled to the area below the external cutting tool 25 (see FIG. 3). When moved over the input gear 26, the rotary cutting tool 15 is guided upwards into the inside of the corresponding can body C. The pitch between the inner face 31 of the external cutting tool 25 and the grained peripheral face 36 of the rotary table 35 is sufficient for the passing of the can body C. During rotary motion of the rotary carrier 4, the can body C is received in the cutting apparatus 1. The revolving speed of the rotary table 35 is about twice the speed of the rotary cutting tools 15, so that the can body C at each rotary cutting tool 15 is respectively turned from the rotary table 35 to the external cutting tool 25.

During the operation of the cutting apparatus 1, the can body C is squeezed against the inner face 31 of the cutting edge 30. The pitch between the cutting edge 18 of each rotary cutting tool 15 and the cutting edge of the external cutting tool 25 is gradually reduced in direction from the input end (the side of the input gear 26 toward the output end (the side of the output gear 27), so that can bodies C of different heights are cut off at a predetermined cutting line L into equal height.

Figure 7:
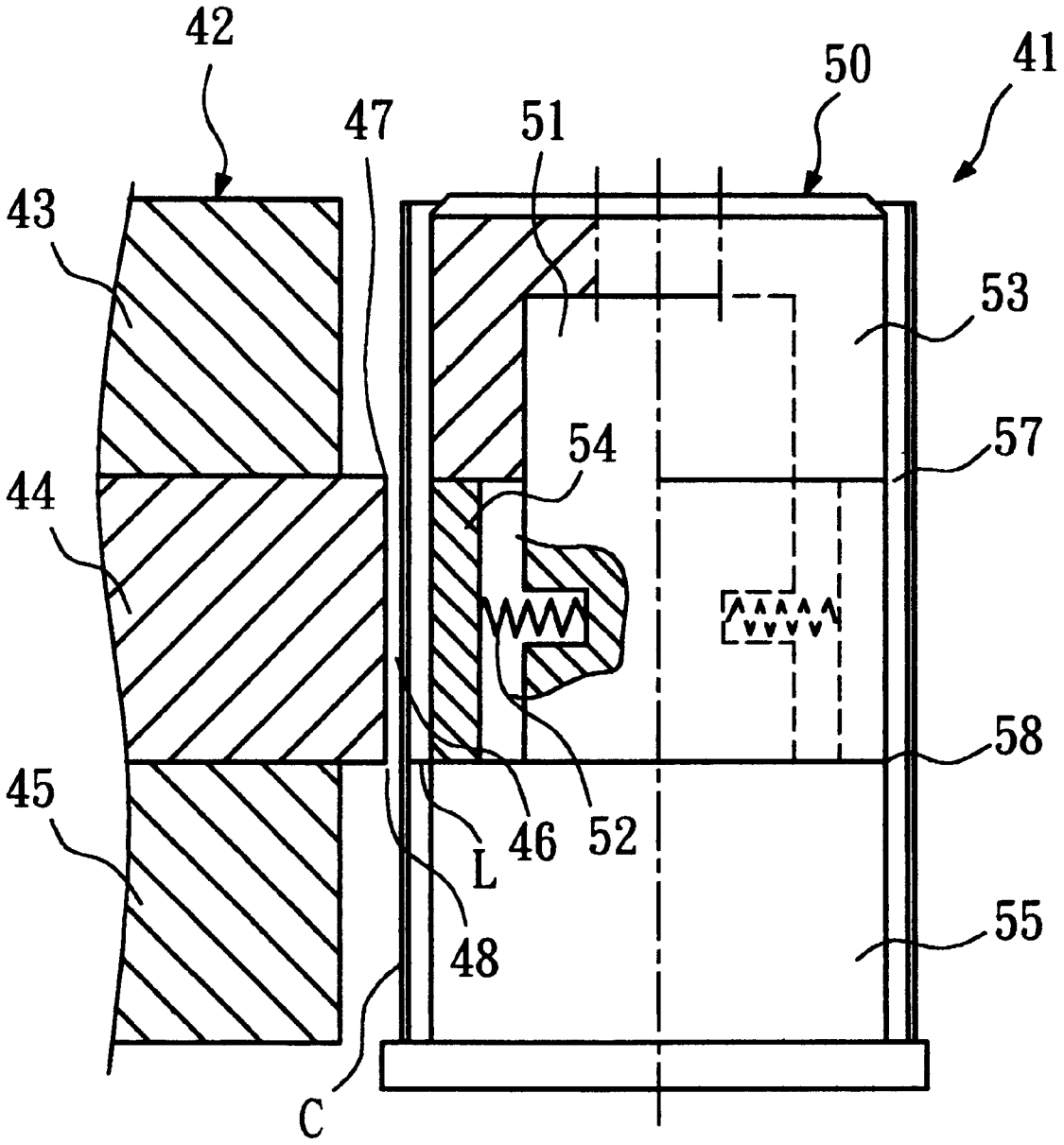
FIG. 7 is a sectional view of a part of a cutting apparatus according to a second embodiment of the present invention.

FIG. 7 shows a cutting apparatus 41 suitable for cutting the workpiece into three different heights. According to this alternate form, the fixed external cutting tool 42 of the cutting apparatus 41 comprises three segments, namely, the top cutting segment 43, the intermediate cutting segment 44, and the bottom cutting segment 45 disposed at different elevations. The intermediate cutting segment 44 has an inner face 46 and two cutting edges 47 and 48 respectively disposed at the top and bottom sides of the inner face 46. The rotary cutting tool, referenced by 50, comprises a shank 51, a first end block 53 and a second end block 55 respectively provided at the top and bottom ends of the shank 51, a barrel 54 supported on spring means 52 around the shank 51 between the end blocks 53 and 55. When standing still, the barrel 54 and the end blocks 53 and 55 are coaxially aligned. Same as the embodiment shown in FIGS. from 1 through 6, the rotary cutting tools 50 of the cutting apparatus 41 are rotated and moved up and down during the operation of the cutting apparatus 41.

The distance between the inner face 46 of the intermediate cutting segment 44 of the fixed external cutting tool 42 and the longitudinal central axis 5 is gradually reduced in the path. Therefore, the rotary cutting tool 50 gives a pressure to the can body C against the inner face 46 of the intermediate cutting segment 44 of the fixed external cutting tool 42. Following the reducing of the radius of the inner face 46, the cutting edges 47 and 48 of the fixed external cutting tool 42 work with the cutting edges 57 and 58 of the rotary cutting tool 50 to cut the workpiece into three heights. During cutting, the barrel 54 is forced to roll off the workpiece.

Figure 8:
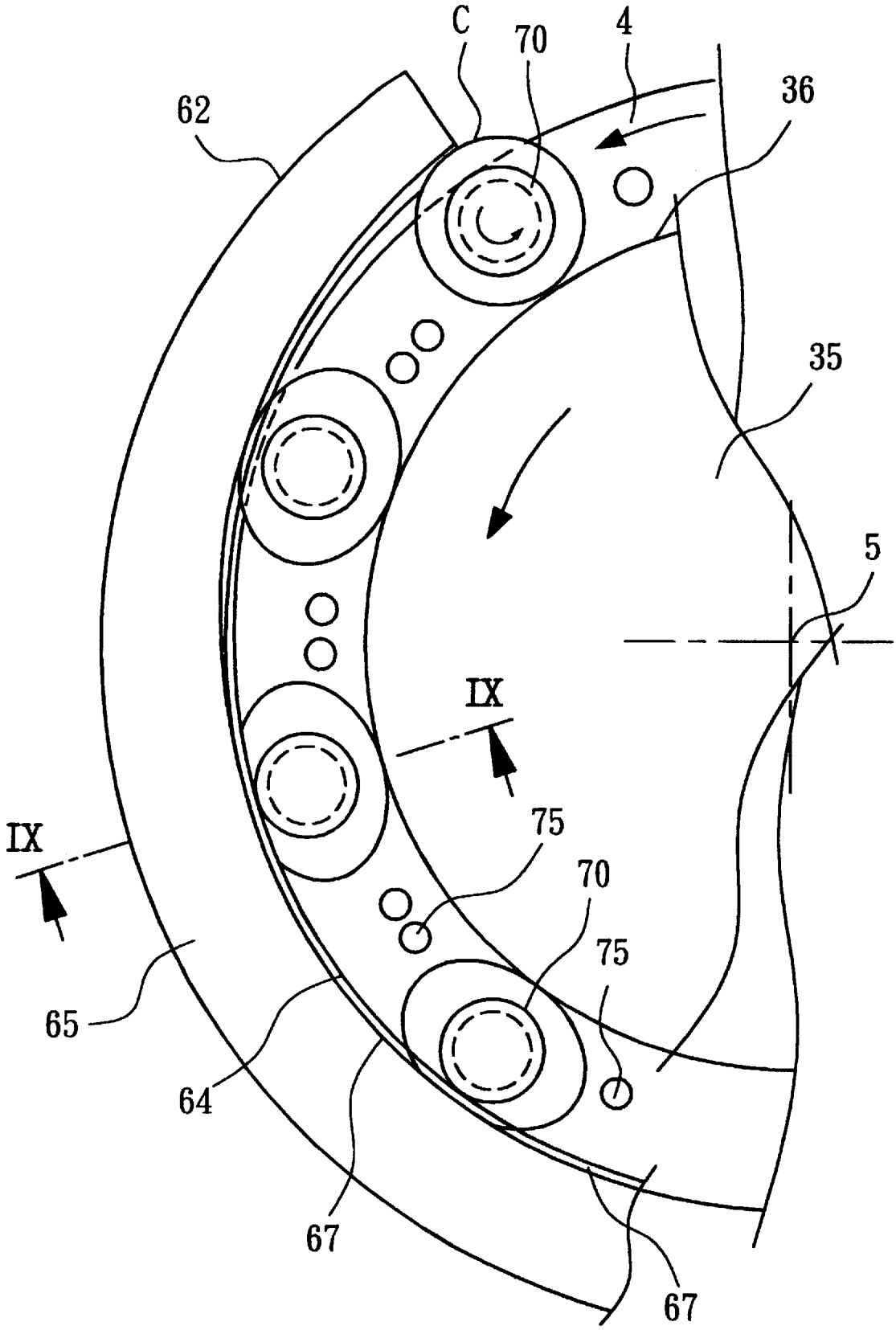
FIG. 8 is a top view of a part of the cutting apparatus according to the second embodiment of the present invention.
Figure 9:
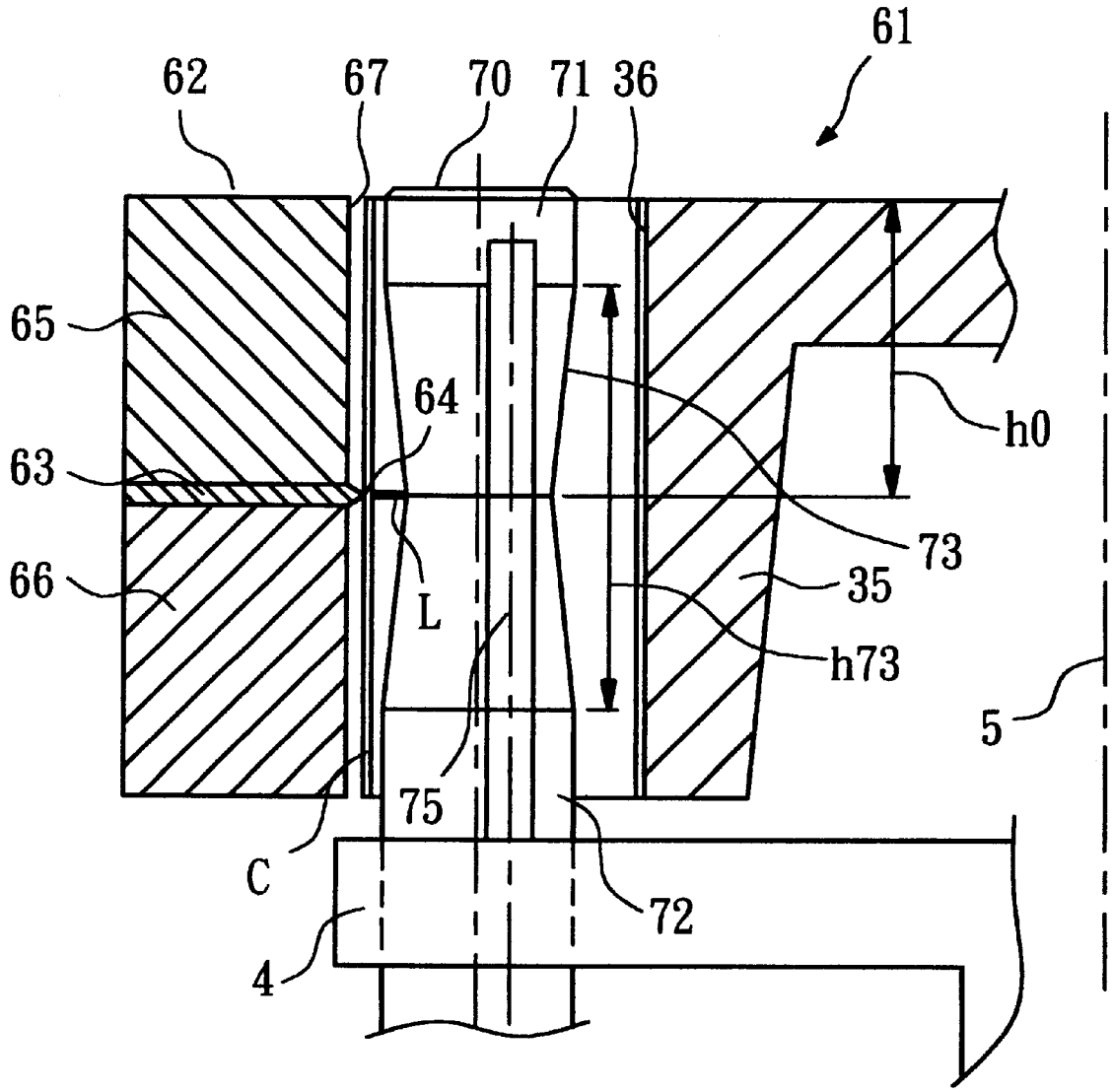
FIG. 9 is a sectional view taken along line IX—IX of FIG. 8.

FIGS. 8 and 9 show a cutting apparatus 61 practical for cutting the workpiece into two heights. According to this alternate form, the fixed external cutting tool 62 comprises an upper tool body 65, a lower tool body 66, and a cutting blade 63 sandwiched in between the upper tool body 65 and the lower tool body 66. The cutting blade 63 has a cutting edge 64 perpendicularly aimed at the longitudinal central axis 5. The upper tool body 65 and the lower tool body 66 have a vertical inner sidewall 67 (see FIG. 9). Similar to the embodiment shown in FIGS. 1 and 2, the cutting apparatus 61 comprises a rotary table 35 adapted to be turned about the longitudinal central axis 5 and having a grained peripheral face 36, a rotary carrier 4 adapted to be turned about the longitudinal central axis 5, and a plurality of rotary cutting tools 70 respectively mounted in respective guide holes (not shown) in the rotary carrier 4. The rotary cutting tools 70 function in the same way as that of the embodiment shown in FIGS. 1 and 2.

Each rotary cutting tool 70 comprises two cylindrical end blocks 71 and 72, and a peripheral groove 73 between the end blocks 71 and 72. The vertical height h73 of the peripheral groove 73 is about 10/7 or 1.43 of the height h0 of a well-cut can body.

In order to guide the can bodies C into the path for cutting, each rotary cutting tool 70 is equipped with two rolling barrels 75 mounted on the rotary carrier 4.

Figure 10:
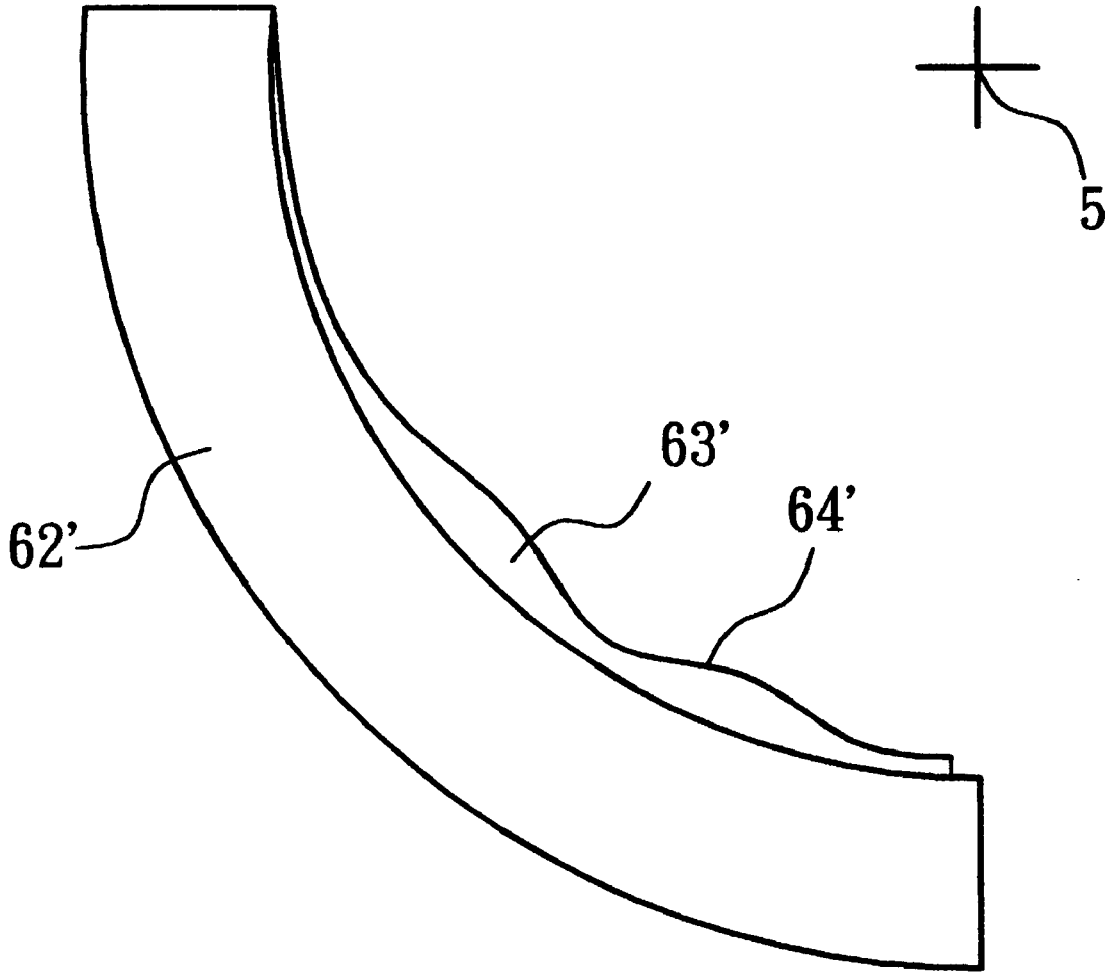
FIG. 10 is a top view showing a fixed cutting tool with a corrugated cutting edge according to the present invention.

Referring to FIG. 10, the fixed cutting tool 62' comprises a cutting blade 63' having a corrugated cutting edge 64' extended vertically along the length. The rotary cutting tool 70 rolls off the can body C carried thereon, producing a buffering effect when cutting the can body C into two heights.

Figure 11:
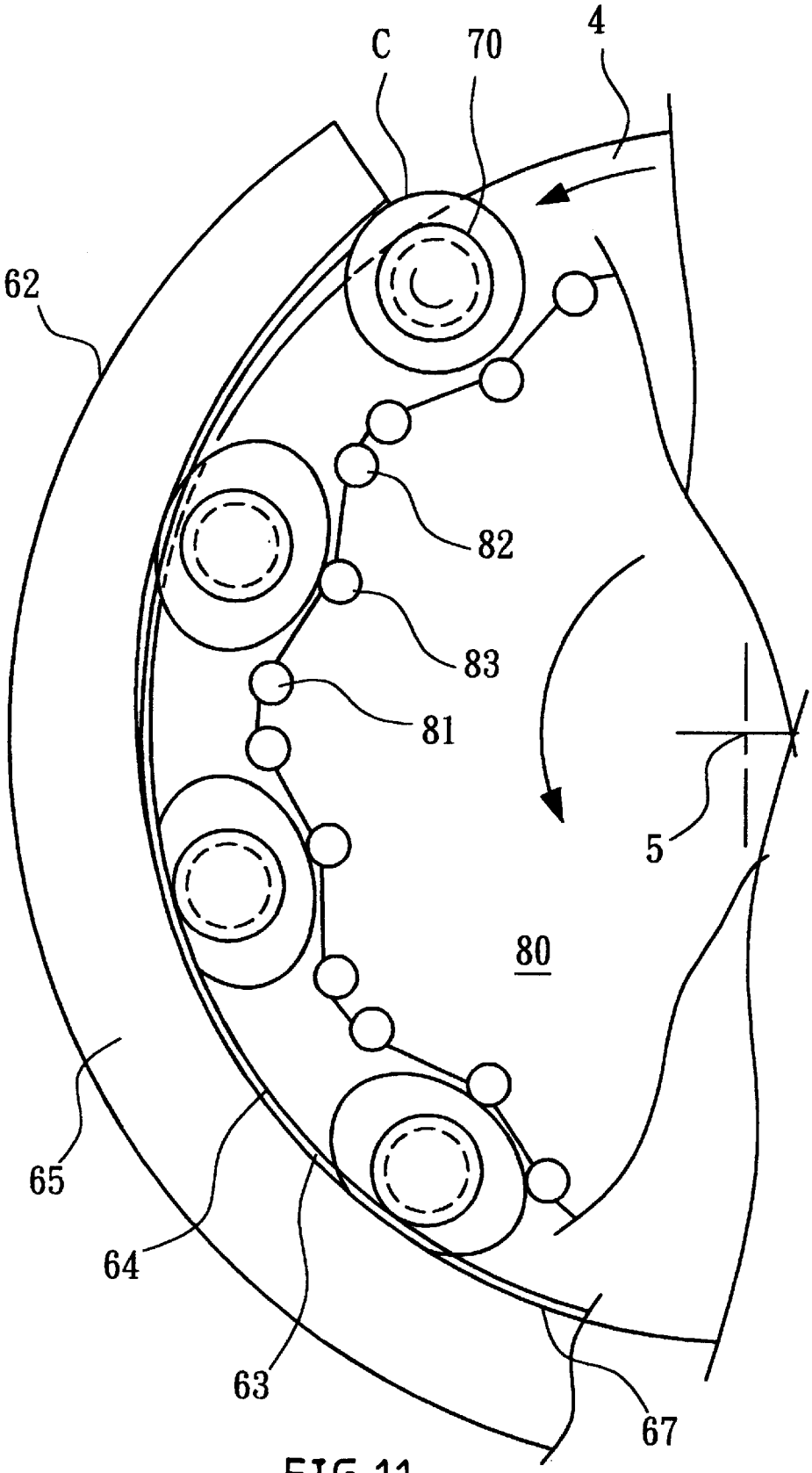
FIG. 11 is a top plain view of a part of another alternate form of the present invention.

Referring to FIG. 11, a rotary table 80 is turned about the longitudinal central axis. The revolving speed of the rotary table 80 is equal to the rotary carrier 4. Rollers 81, 82, and 83 are provided at the rotary table 80 and arranged in sets corresponding to the rotary cutting tools 70. Rollers 81, 82, and 83 are moved with the rotary table 80 relative to the rotary cutting tools 70 to squeeze the can body C on each rotary cutting tool 70. Each set of rollers include a first roller 81 and a second roller 82 equally spaced from the longitudinal central axis 5, and a third roller 83 defining with the first roller 81 and the second roller 82 a can body C receiving mouth 84.

Figure 12:
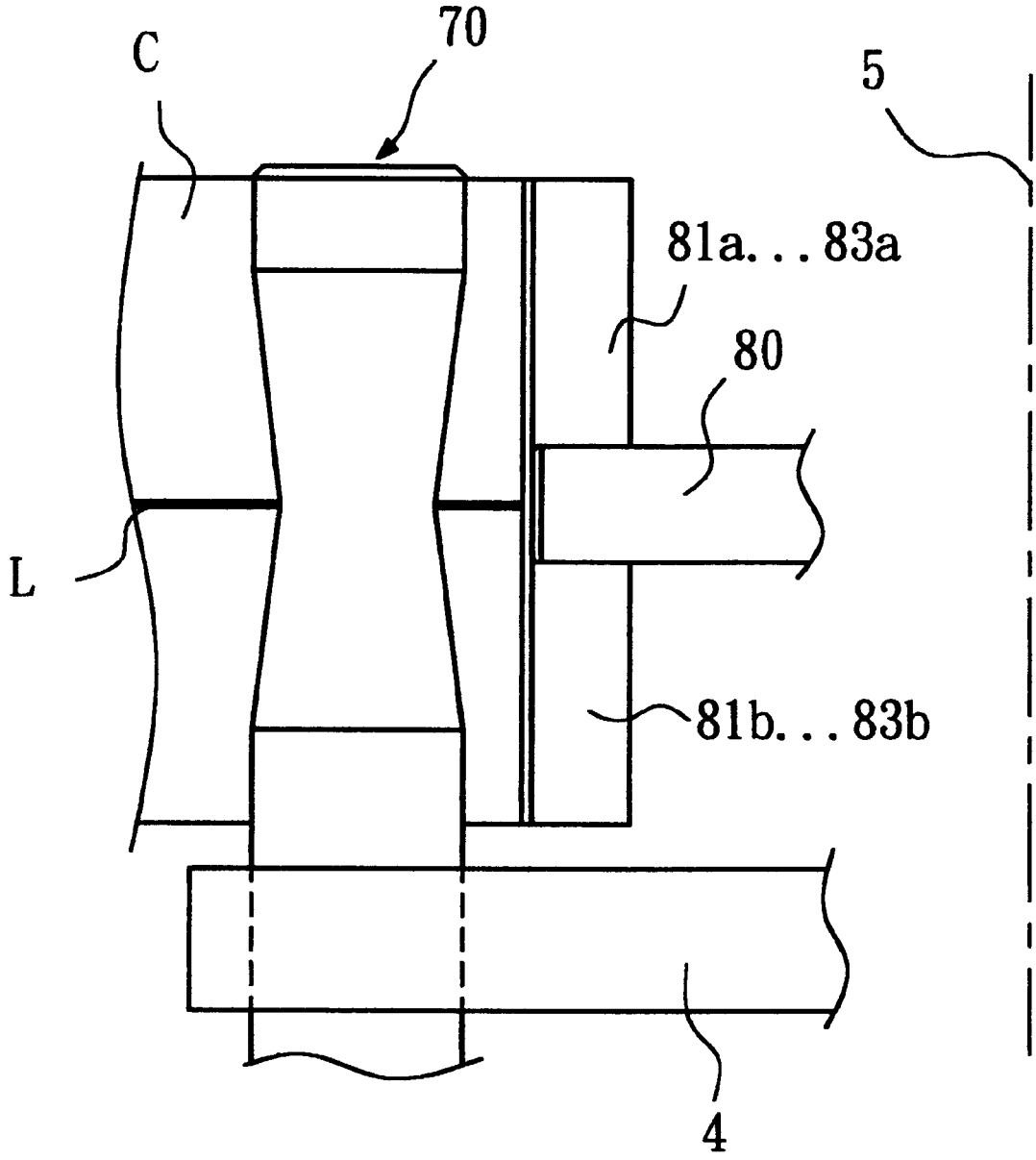
FIG. 12 is a sectional view showing rollers arranged at top and bottom sides of the rotary table and pressed on the periphery of the can body against the rotary cutting tool according to the present invention.

Referring to FIG. 12, rollers 88*a*~83*a* and rollers 81*b*~83*b* are symmetrically arranged at top and bottom sidewalls of the rotary table 80.

Figure 13:
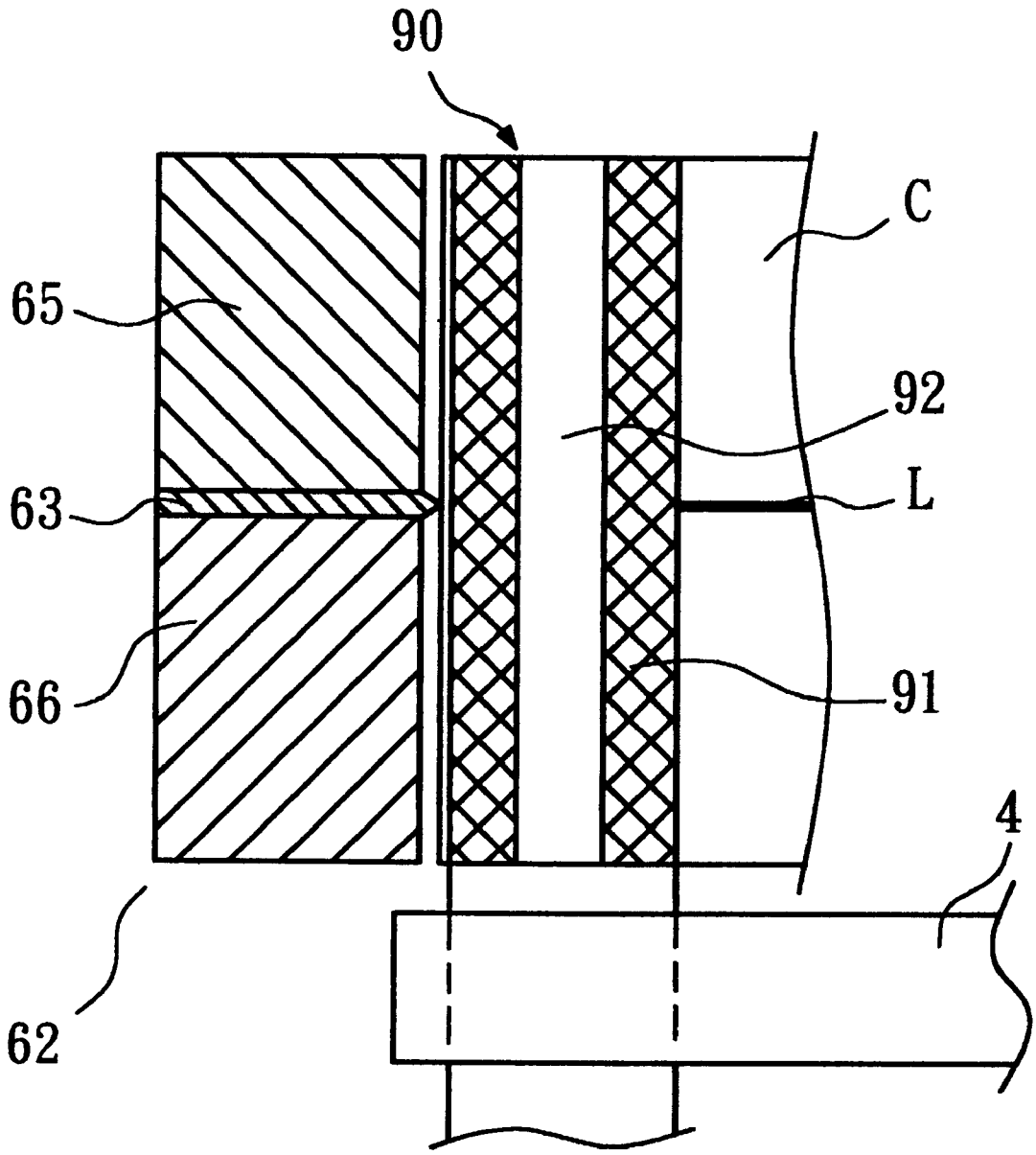
FIG. 13 is a sectional view showing the elastic rotary barrel of the rotary cutting tool pressed on the peripheral wall of the can body against the butting blade of the fixed cutting tool according to the present invention.

Referring to FIG. 13, the rotary cutting tool 90 is comprised of a cylindrical shaft 92 and an elastic barrel 91 sleeved onto the. shaft 92. The elastic barrel 91 is made of elastic material, for example, polyurethane. The peripheral wall of the can body C is supported on the periphery of the elastic barrel 91 and pressed against the cutting blade 63, and therefore the can body C is cut smoothly without producing a curved edge.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A multi-height cutting apparatus comprising:

a column (3) having a longitudinal central axis (5);

fixed cutting tool means (25;42) disposed around said central axis (5), said fixed cutting tool means (25;42) having at least one cutting edge (30; 47, 48) extended around said central axis (5); and a plurality of rotary cutting tool means (15;50) spaced between said column (3) and said fixed cutting tool means (25;42) and respectively rotated to cut can bodies (C) being delivered one after another through a circular path between the at least one cutting edge (30; 47, 48) of said fixed cutting tool means (25;42) and said rotary cutting tool means (15;50);

wherein the at least one cutting edge (38; 47, 48) of said fixed cutting tool means (25;42) each have a stepped cutting structure, and said rotary cutting tool means (15;50) each have a cutting edge (18;57, 58) in a stepped structure thereof corresponding to the at least one cutting edge (30; 47, 48) of said fixed cutting tool means (25;42) for cutting each delivered can body (C) at different heights.

2. The multi-height cutting apparatus as claimed in claim 1 further comprising a shaft (34) axially mounted in said column (3), and a rotary table (35) mounted on a top side of said shaft (34) and adapted for rotating can bodies (C) on said rotary cutting tool means (15; 50) against the at least one cutting edge (30; 47, 48) of said fixed cutting tool means (25;42), one half of the outer diameter of said rotary table (35) being greater than the shortest distance between the at least one cutting edge (30; 47, 48) of said fixed cutting tool means (25;42) and said longitudinal central axis (5) minus the diameter of said can bodies (C).

3. The multi-height cutting apparatus as claimed in claim 2 wherein one half of the outer diameter of said rotary table (35) is about equal to ½~⅚ of the shortest distance between the at least one cutting edge (30; 47, 48) of said fixed cutting tool means (25;42) and said longitudinal central axis (5) minus the diameter of said can bodies (C), or preferably equal to ⅔ of shortest distance between the at least one cutting edge (30; 47, 48) of said fixed cutting tool means (25;42) and said longitudinal central axis (5) minus the diameter of said can bodies (C).

4. The multi-height cutting apparatus as claimed in claim 3 wherein said rotary table (35) has a grained peripheral face (36).

5. The multi-height cutting apparatus as claimed in claim 1 wherein said fixed external cutting tool means (42) comprises a top cutting segment (43), an intermediate cutting segment (44), and a bottom cutting segment (45); said rotary cutting tool means (50) comprises a shank (51), a first end block (53) and a second end block (55) respectively provided at top and bottom ends of said shank (51), a barrel (54) supported on spring means (52) around said shank (51) between said end blocks (53; 55).

6. The multi-height cutting apparatus as claimed in claim 1 wherein said rotary cutting tool means (90) has barrel-like external flexible members (91) disposed at top and bottom sides of the stepped cutting edge thereof.

7. A multi-height cutting apparatus (61) comprising:

a column (3) having a longitudinal central axis (5);

fixed cutting tool means (62) disposed around said central axis (5), said fixed cutting tool means (62) having at least one cutting edge (64, 64') extended around said central axis (5); and a plurality of rotary cutting tool means (70;90) spaced between said column (3) and said fixed cutting tool means (62) and respectively rotated to cut can bodies (C) being delivered one after another through a circular path between the at least one cutting edge (64, 64') of said fixed cutting tool means (62) and said rotary cutting tool means (15;50);

wherein said fixed cutting tool means (62) comprises an upper tool body (65), a lower tool body (66), and a cutting blade (63) sandwiched in between said upper tool body (65) and said lower tool body (66), said cutting blade (63, 63') having a cutting edge (64,64') perpendicularly aimed at said longitudinal central axis (5); said rotary cutting tool means (70) comprises a barrel-like external member (91) of elastic material having a peripheral groove (73), said peripheral groove (73) having a vertical height about ½~⅔ of the height from the peripheral edge of the can body to the cutting area; a shaft (34) is axially mounted in said column (3) to support a rotary table (35) adapted for rotating can bodies (C) on said rotary cutting tool means (70) against the at least one cutting edge (64, 64') of said fixed cutting tool means (62).

8. The multi-height cutting apparatus (61) as claimed in claim 7 wherein the cutting edge (64') of said cutting blade (63') is corrugated and extended vertically along the length of said cutting blade (63').

9. The multi-height cutting apparatus (61) as claimed in claim 8 wherein said rotary table (35, 80) having a cylindrical peripheral face (36).

10. The multi-height cutting apparatus (61) as claimed in claim 9 wherein said cylindrical peripheral face (36) of said rotary table (35) is a grained face.

11. The multi-height cutting apparatus (61) as claimed in claim 8 wherein said rotary cutting tool means (70) is respectively matched with a pair of rolling barrels (75) adapted for guiding each can body (C) into position for cutting.

12. The multi-height cutting apparatus (61) as claimed in claim 8 wherein said rotary table (80) is connected in parallel to said rotary carrier (4) and turned about said longitudinal central axis (5), having a plurality of rollers (81~83; 81*a*~83*a*; 81*b*~83*b*) arranged in pair in parallel to said longitudinal central axis at the periphery thereof and adapted for squeezing the can body (C) on each of said rotary cutting tool means (90) against said fixed cutting tool means (62).

* * * * *